US008734087B2

(12) United States Patent
Converse

(10) Patent No.: US 8,734,087 B2
(45) Date of Patent: May 27, 2014

(54) MULTI-STAGE CENTRIFUGAL FAN

(75) Inventor: David G. Converse, Hampden, MA (US)

(73) Assignee: Hamilton Sundstrand Space Systems International, Inc., Windsor Locks, CT (US)

( * ) Notice: Subject to any disclaimer, the term of this patent is extended or adjusted under 35 U.S.C. 154(b) by 954 days.

(21) Appl. No.: 12/824,905

(22) Filed: Jun. 28, 2010

(65) Prior Publication Data

US 2011/0318175 A1 Dec. 29, 2011

(51) Int. Cl.
*F04D 17/12* (2006.01)
*F04D 29/24* (2006.01)

(52) U.S. Cl.
USPC ..... 415/83; 415/199.1

(58) Field of Classification Search
USPC ..... 415/81, 83–87, 198.1, 199.1, 199.2, 415/199.3; 416/179, 180, 182, 183, 185, 416/223 B
See application file for complete search history.

(56) References Cited

U.S. PATENT DOCUMENTS

| | | | | |
|---|---|---|---|---|
| 3,040,971 | A * | 6/1962 | Pavlecka | 415/1 |
| 3,303,996 | A | 2/1967 | Bayless | |
| 4,428,715 | A * | 1/1984 | Wiggins | 415/199.2 |
| 4,859,144 | A | 8/1989 | Houston | |
| 6,007,300 | A | 12/1999 | Saeki et al. | |
| 6,312,220 | B1 * | 11/2001 | Horner | 415/199.2 |
| 6,371,724 | B2 * | 4/2002 | Nagaoka et al. | 415/208.3 |
| 6,589,013 | B2 * | 7/2003 | Abdallah | 415/199.2 |
| 6,715,987 | B2 * | 4/2004 | Rossi et al. | 415/191 |
| 7,244,099 | B2 | 7/2007 | Yamasaki | |
| 7,390,163 | B2 * | 6/2008 | Clauson | 415/83 |
| 7,435,051 | B2 | 10/2008 | Obinelo et al. | |
| 7,618,239 | B2 | 11/2009 | Hatsugai et al. | |
| 8,029,237 | B2 * | 10/2011 | Chang et al. | 415/206 |
| 8,231,341 | B2 * | 7/2012 | Anderson et al. | 415/191 |
| 2009/0145102 | A1 | 6/2009 | Roberge et al. | |
| 2011/0189003 | A1 * | 8/2011 | Iida | 415/199.2 |

FOREIGN PATENT DOCUMENTS

| | | | |
|---|---|---|---|
| WO | 03/031825 | A1 | 4/2003 |
| WO | 2006/059968 | A1 | 6/2006 |
| WO | 2006/059969 | A1 | 6/2006 |
| WO | 2006/059993 | A1 | 6/2006 |
| WO | 2006/060011 | A1 | 6/2006 |
| WO | 2008/156438 | A1 | 12/2008 |

OTHER PUBLICATIONS

Frank P. Bleier, "Centrifugal Fans", Fan Handbook-Selection, Application and Design, Chapter 7, McGraw-Hill 1998.*

* cited by examiner

*Primary Examiner* — Edward Look
*Assistant Examiner* — Christopher R Legendre
(74) *Attorney, Agent, or Firm* — Cantor Colburn LLP

(57) ABSTRACT

A multi-stage centrifugal fan is provided and includes first and second stages of a rotor having substantially axially aligned rotor vanes formed to impart energy to a fluid moving in an outward radial direction when the first and second stages of the rotor rotate about a centerline and a stator having stator vanes radially interposed between and substantially axially aligned with the first and second stage rotor vanes.

17 Claims, 2 Drawing Sheets

MULTI-STAGE CENTRIFUGAL FAN

The U.S. Government may have certain rights in this invention pursuant to Contract Number RH6-118203 with the National Aeronautics and Space Administration.

BACKGROUND OF THE INVENTION

The subject matter disclosed herein relates to a multi-stage centrifugal fan.

Fan designs are often constrained by envelope size requirements, rotational speed requirements, weight requirements and power requirements. Meanwhile, aerodynamic performance and motor electrical performance of fans are heavily influenced by these factors and, in particular, rotational speed of the fan. Thus, if improved aerodynamic performance is required of a fan but the fan is already operating at a practical limit for its rotational speed due to motor performance characteristics, fan design improvements may be required.

It is often the case, however, that envelope size requirements are stringent and, as such, there may not be room or space available for a larger fan design for a given fan application. Given that pressure rise requirements (i.e., a higher delta P) keep growing for certain fan applications and a way to ordinarily accommodate a higher delta P is to spin the fan faster or grow the fan rotor diameter, a new manner of accommodating a higher delta P may be beneficial.

BRIEF DESCRIPTION OF THE INVENTION

According to one aspect of the invention, a multi-stage centrifugal fan is provided and includes first and second stages of a rotor having substantially axially aligned rotor vanes formed to impart energy to a fluid moving in an outward radial direction when the first and second stages of the rotor rotate about a centerline and a stator having stator vanes radially interposed between and substantially axially aligned with the first and second stage rotor vanes.

According to another aspect of the invention, a multi-stage centrifugal fan is provided and includes at least first and second stages of a rotor having substantially axially aligned rotor vanes formed to impart energy to a fluid moving in an outward radial direction when the at least first and second stages of the rotor are driven to rotate about a centerline and a stator having stator vanes radially interposed between and substantially axially with the at least first and second stage rotor vanes to redirect a tangential direction of flow in a direction opposite a direction of rotor rotation.

According to yet another aspect of the invention, a multi-stage centrifugal fan assembly is provided and includes a body formed to define a flow path along which fluid is directed to flow, a rotor disposed along the flow path and including at least first and second stages having substantially axially aligned rotor vanes formed to impart energy to the fluid moving in an outward radial direction when the at least first and second stages rotate about an axial centerline of the rotor and a stator having stator vanes radially interposed between and substantially axially with the at least first and second stage rotor vanes to redirect a tangential direction of flow in a direction opposite a direction of rotor rotation.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
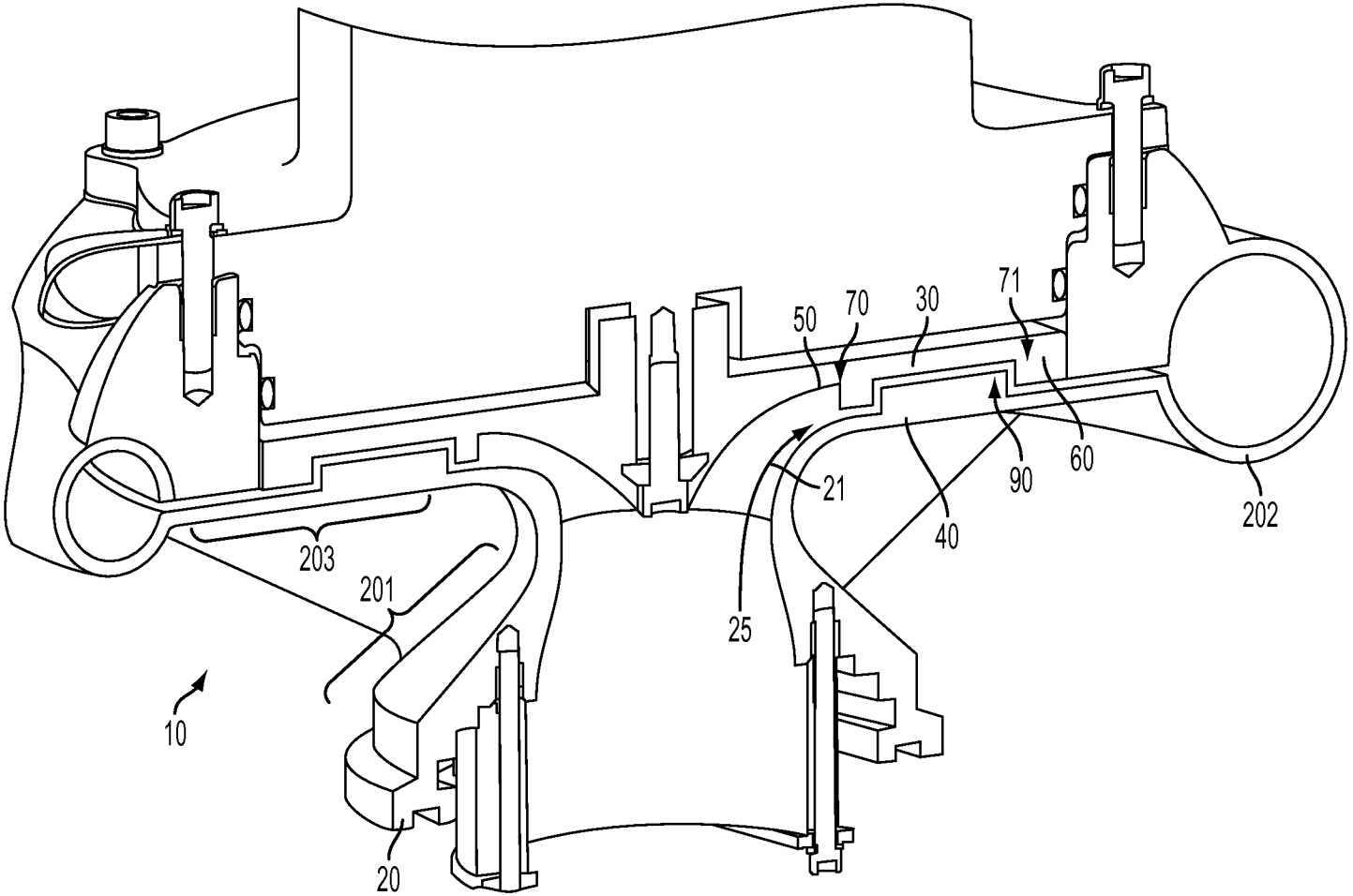
FIG. 1 is a perspective view of a multi-stage centrifugal fan.
Figure 3:
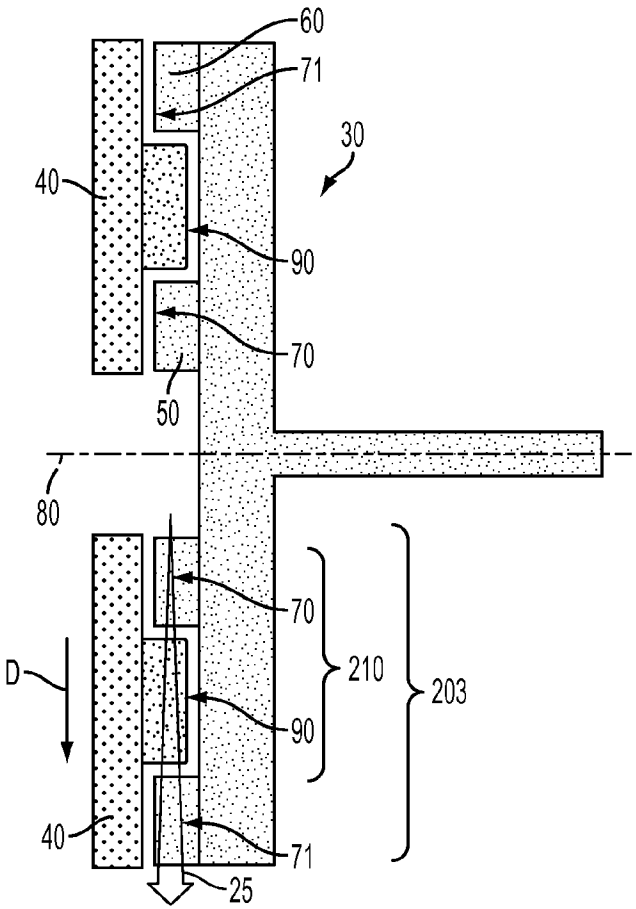
FIG. 3 is a side view of the rotor stages and stator of the multi-stage centrifugal fan of FIG. 1.
Figure 2:
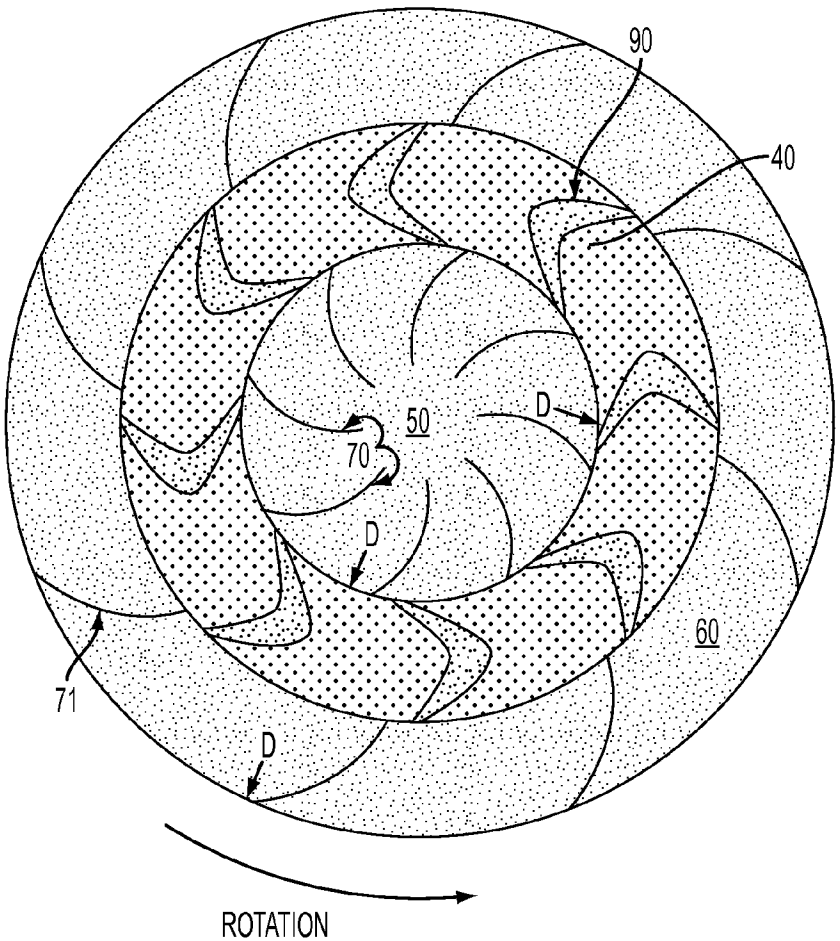
FIG. 2 is a top view of the rotor stages and stator of the multi-stage centrifugal fan of FIG. 1.

With reference to FIGS. 1, 2 and 3, a multi-stage centrifugal fan assembly 10 is provided and includes a body 20 formed to define a flow path 21 along which fluid 25 is directed to flow, a rotor 30 and a stator 40. The rotor 30 includes at least a first stage 50 and a second stage 60, which are substantially coaxial and at least partially coplanar, and which are disposed along the flow path 21.

The first stage 50 of the rotor 30 has first stage rotor vanes 70 and the second stage 60 of the rotor 30 has second stage rotor vanes 71, where the first stage of the 50 rotor 30 is disposed within a radial interior of the second stage 60 of the rotor 30 and the first stage rotor vanes 70 and the second stage rotor vanes 71 are substantially axially aligned with one another. With this configuration, the first stage rotor vanes 70 and the second stage rotor vanes 71 are formed to impart energy to the fluid 25 in a tangential direction while the bulk of the fluid 25 is moving in the radial direction, D, when the at least first and second stages 50 and 60 rotate about an axial centerline 80 of the rotor 30.

The stator 40 has stator vanes 90, which are radially interposed between and substantially axially aligned with the first and second stage rotor vanes 70 and 71, to redirect the tangential component of the flow opposite the direction of rotation. As such, an aerodynamic performance of the rotor 30 can be increased without increasing a size of the rotor 30 or the rotation speed of the at least first and second stages 50 and 60.

Although described above as having first and second stages 50 and 60, it is understood that the rotor 30 may have additional stages as available given spatial, weight, cost and similar requirements. Similarly, the stator 40 may include additional vane stages as well. For purposes of brevity and clarity, only the first and second stages 50 and 60 will hereinafter be discussed.

The axial centerline 80 of the rotor 30 is substantially coaxial with an axial centerline of the body 20. Thus, as shown in FIG. 1, the rotor 30 is generally disposed within a central portion of the body 20 where the body 20 includes an inlet section 201, an outlet tube 202 and an intermediate section 203. The inlet section 201 is defined upstream from the rotor 30 such that the fluid 25 flows through the inlet section 201 toward the rotor 30. The outlet tube 202 is formed downstream from and radially outwardly of the rotor 30 and is receptive of the fluid 25 flowing radially outwardly and away from the rotor 30. The rotor 30 is disposed in the intermediate section 203, which allows the outlet tube 202 to fluidly communicate with the inlet section 201.

The stator 40 and the stator vanes 90 may be machined from and/or into a wall of the body 20 at the intermediate section 203 such that the stator 40 is integrally coupled to the body 20. In alternate embodiments, the stator 40 may be separate from and removably connected to the body 20. In any case, the stator 40 is positioned such that the stator vanes 90 extend at least partially through planes of the first and second stage rotor vanes 70 and 71. Thus, the flow path 21 is formed with a labyrinthine section 210 within the intermediate section 203 where the fluid 25 flows in the outward radial direction, D, along the first stage rotor vanes 70, along the stator vanes 90, along the second stage rotor vanes 71 and then to the outlet tube 202. Moreover, while the first and second stages of the rotor 50 and 60 are substantially coaxial and at least partially coplanar, in the intermediate section 203, a profile of the first and second stage rotor vanes 70 and 71 may be curved.

As shown in FIG. 2, the first and second stage rotor vanes 70 and 71 may be substantially spiral shaped and, in some cases, may have substantially similar shapes although this is merely exemplary and not required. The stator vanes 90 may be similarly spiral shaped or, as shown in FIG. 2, substantially hook shaped. The first stage rotor vanes 70 may be substantially uniformly spaced from one another, the second stage rotor vanes 71 may be substantially uniformly spaced from one another and the stator vanes 90 may be substantially uniformly spaced from one another. With the first and second stage rotor vanes 70 and 71 and the stator vanes 90 shaped in this way, when the rotor 30 rotates in the rotation direction shown by the rotation arrow of FIG. 2, the fluid 25 is energized by the first stage rotor vanes 70, the tangential velocity is redirected and reversed by the stator vanes 90 and then energized again by the second stage rotor vanes 71, as shown by the increasing weight of the arrow representing the fluid 25 in FIG. 3. Here, the total energy imparted to the fluid 25 is greater than what would otherwise be added to the fluid 25 by a conventional fan (i.e., a single stage rotor).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A multi-stage centrifugal fan assembly, comprising:

a body formed to define a flow path along which fluid is directed to flow;

a rotor disposed along the flow path and including at least first and second stages having substantially axially aligned rotor vanes formed to impart energy to the fluid moving in an outward radial direction when the at least first and second stages rotate about an axial centerline of the rotor; and a stator having a radial dimension and stator vanes radially interposed between and substantially axially with the at least first and second stage rotor vanes to redirect a tangential direction of flow in a direction opposite a direction of rotor rotation, each of the stator vanes being hook shaped and including a pressure surface, the pressure surface comprising a leading edge, a trailing edge, and a vertex, the leading edge located at an inner end of the pressure surface and proximate to the vanes of the first rotor stage and the trailing edge located at an outer end of the pressure surface and proximate to the vanes of the second rotor stage, the leading edge and the trailing edge being configured to lead the vertex with respect to a direction of rotation of the rotor about the centerline and relative to the radial dimension of the stator.

2. The multi-stage centrifugal fan according to claim 1, wherein the body comprises:

an inlet section, upstream from the rotor in an axial direction, through which the fluid flows toward the rotor;

an outlet tube, downstream from the rotor in a radial direction, into which the fluid flows from the rotor; and an intermediate section in which the rotor is disposed and by which the outlet tube fluidly communicates with the inlet section.

3. The multi-stage centrifugal fan according to claim 1, wherein the first and second stages are substantially coaxial.

4. The multi-stage centrifugal fan according to claim 1, wherein the first and second stages are substantially coplanar.

5. The multi-stage centrifugal fan according to claim 1, wherein the rotor vanes of the first and second stages are substantially spiral shaped.

6. The multi-stage centrifugal fan according to claim 1, wherein the rotor vanes of the first and second stages have substantially similar shapes.

7. The multi-stage centrifugal fan according to claim 1, wherein the stator is integrally coupled to an interior surface of the body.

8. The multi-stage centrifugal fan according to claim 1, wherein the stator is rotationally fixed relative to the body.

9. The multi-stage centrifugal fan according to claim 1, wherein the rotor vanes of the first stage are substantially uniformly spaced from one another, the rotor vanes of the second stage are substantially uniformly spaced from one another and the stator vanes are substantially uniformly spaced from one another.

10. A multi-stage centrifugal fan, comprising:

first and second stages of a rotor having substantially axially aligned rotor vanes formed to impart energy to a fluid moving in an outward radial direction when the first and second stages of the rotor rotate about a centerline; and a stator having a radial dimension and stator vanes radially interposed between and substantially axially aligned with the first and second stage rotor vanes, each of the stator vanes being hook shaped and including a pressure surface, the pressure surface comprising a leading edge, a trailing edge, and a vertex, the leading edge located at an inner end of the pressure surface and proximate to the vanes of the first rotor stage and the trailing edge located at an outer end of the pressure surface and proximate to the vanes of the second rotor stage, the leading edge and the trailing edge being configured to lead the vertex with respect to a direction of rotation of the rotor about the centerline and relative to the radial dimension of the stator.

11. The multi-stage centrifugal fan according to claim 10, wherein the rotor vanes of the first and second stages are substantially spiral shaped.

12. The multi-stage centrifugal fan according to claim 10, wherein the stator is rotationally fixed.

13. The multi-stage centrifugal fan according to claim 10, wherein the rotor vanes of the first stage are substantially uniformly spaced from one another, the rotor vanes of the second stage are substantially uniformly spaced from one another and the stator vanes are substantially uniformly spaced from one another.

14. A multi-stage centrifugal fan, comprising:

at least first and second stages of a rotor having substantially axially aligned rotor vanes formed to impart energy to a fluid moving in an outward radial direction when the at least first and second stages of the rotor are driven to rotate about a centerline; and a stator having a radial dimension and stator vanes radially interposed between and substantially axially with the at least first and second stage rotor vanes to redirect a tangential direction of flow in a direction opposite a direction of rotor rotation, each of the stator vanes being hook shaped and including a pressure surface, the pressure surface comprising a leading edge, a trailing edge, and the vertex, the leading edge located at an inner end of the pressure surface and proximate to the vanes of the first rotor stage and the trailing edge located at an outer end of the pressure surface and proximate to the vanes of the second rotor stage, the leading edge and the trailing edge being configured to lead the vertex with respect to a direction of rotation of the rotor about the centerline and relative to the radial dimension of the stator.

15. The multi-stage centrifugal fan according to claim 14, wherein the rotor vanes of the at least first and second stages are substantially spiral shaped.

16. The multi-stage centrifugal fan according to claim 14, wherein the stator is rotationally fixed.

17. The multi-stage centrifugal fan according to claim 14, wherein the rotor vanes of the first stage are substantially uniformly spaced from one another, the rotor vanes of the second stage are substantially uniformly spaced from one another and the stator vanes are substantially uniformly spaced from one another.

* * * * *